United States Patent [19]

Kapoor

[11] 4,129,136

[45] Dec. 12, 1978

[54] REJUVENATING ELECTROSTATOGRAPHIC CARRIER PARTICLES

[75] Inventor: Devinder S. Kapoor, Penfield, N.Y.

[73] Assignee: Rank Xerox Limited, London, England

[21] Appl. No.: 825,886

[22] Filed: Aug. 19, 1977

[30] Foreign Application Priority Data

Aug. 25, 1976 [GB] United Kingdom ..... 35346/76

[51] Int. Cl.[2] ..... B08B 7/00

[52] U.S. Cl. ..... 134/2; 134/19; 134/25 R; 134/38; 252/417

[58] Field of Search ..... 134/2, 19, 25 R, 38; 252/417, 62.1; 432/15, 58; 427/142, 345; 34/10

[56] References Cited

U.S. PATENT DOCUMENTS

| | | | |
|---|---|---|---|
| 3,686,034 | 8/1972 | Rothschild | 134/2 |
| 3,850,676 | 11/1974 | Madrid et al. | 252/62.1 X |
| 3,909,392 | 9/1975 | Horecky et al. | 252/417 X |

FOREIGN PATENT DOCUMENTS

| | | | |
|---|---|---|---|
| 1367478 | 9/1974 | United Kingdom | 134/2 |

*Primary Examiner*—Marc L. Caroff

[57] ABSTRACT

Used carrier particles having combustible resinous material on the surface of the core are treated by heating the particles in a fluidized condition to a temperature such as to ignite and burn off the resinous material therefrom.

13 Claims, 9 Drawing Figures

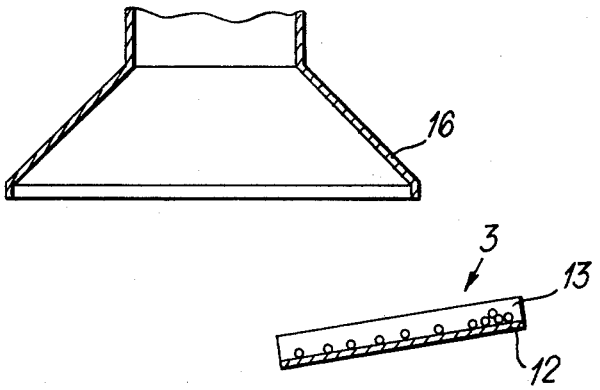
FIG. 1.
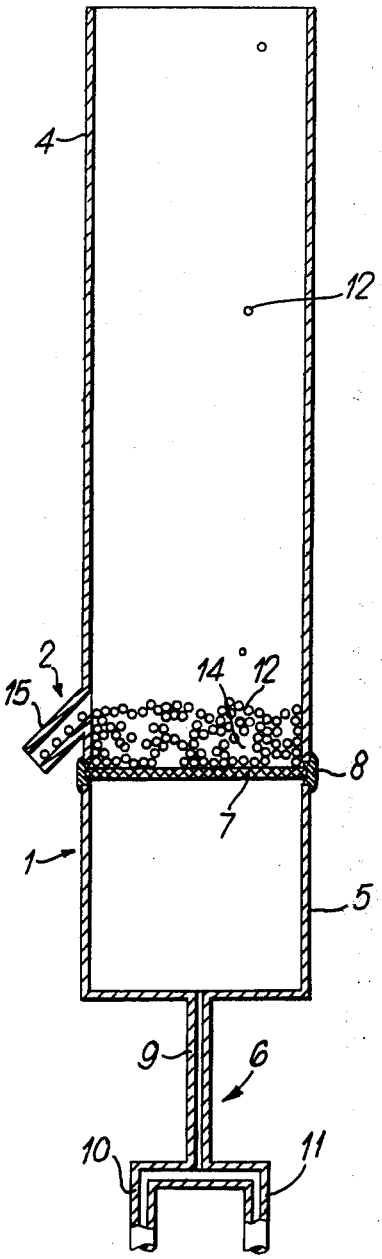
FIG. 1A.
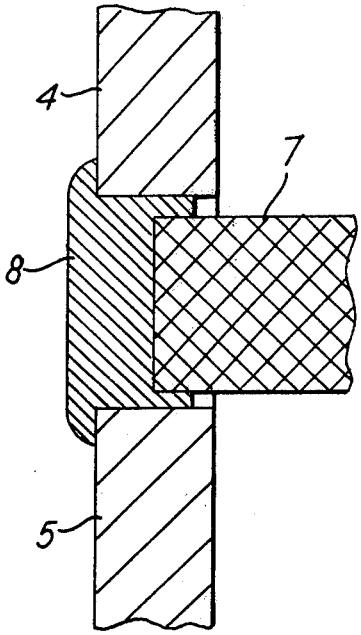

REJUVENATING ELECTROSTATOGRAPHIC CARRIER PARTICLES

BACKGROUND OF THE INVENTION

This invention relates in general to electrostatographic imaging systems, and in particular, to methods and apparatus for rejuvenating electrostatographic carrier particles.

The formation and development of images on the surface of photoconductive materials by electrostatic means is well known. The basic electrostatographic process, as taught by C. F. Carlson in U.S. Pat. No. 2,297,691, involves placing a uniform electrostatic charge on a photoconductive insulating layer, exposing the layer to a light and shadow image to dissipate the charge on the areas of the layer exposed to the light and developing the resulting electrostatic latent image by depositing on the image on a finely divided electroscopic material referred to in the art as "toner". The toner will normally be attracted to those areas of the layer which retain a charge thereby forming a toner image corresponding to the electrostatic latent image. This powder image may then be transferred to a support surface such as paper. The transferred image may subsequently be permanently affixed to the support surface as by heat. Instead of latent image formation by uniformly charging the photoconductive layer and then exposing the layer to a light and shadow image, one may form the latent image by directly charging the layer in image configuration. The powder image may be fixed to the photoconductive layer if elimination of the powder image transfer step is desired. Other suitable fixing means such as solvent or overcoating treatment may be substituted for the foregoing heat fixing step.

Many methods are known for applying the electroscopic particles to the electrostatic latent image to be developed. One development method, as disclosed by E. N. Wise in U.S. Pat. No. 2,618,552 is known as "cascade" development. In this method, a developer material comprising relatively large carrier particles having finely divided toner particles electrostatically clinging to the surface of the carrier particles is conveyed to and rolled or cascaded across the electrostatic latent image bearing surface. The composition of the toner particles is so chosen as to have a triboelectric polarity opposite that of the carrier particles. As the mixture cascades or rolls across the image bearing surface, the toner particles are electrostatically deposited and secured to the charged portion of the latent image and are not deposited on the uncharged or background portions of the image. Most of the toner particles accidentally deposited in the background are removed by the rolling carrier, due apparently to the greater electrostatic attraction between the toner and the carrier than between the toner and the discharged background. The carrier particles and unused toner particles are then recycled. This technique is extremely good for the development of line copy images. The cascade development process is the most widely used commercial electrostatographic development technique. A general purpose office copying machine incorporating this technique is described in U.S. Pat. No. 3,099,943.

Another technique for developing electrostatic latent images is the "magnetic brush" process as disclosed, for example, in U.S. Pat. No. 2,874,063. In this method, a developer material containing toner and magnetic carrier particles is carried by a magnet. The magnetic field of the magnet causes alignment of the magnetic carriers in a brushlike configuration. This "magnetic brush" is engaged with an electrostatic latent image bearing surface and the toner particles are drawn from the brush to the electrostatic latent image by electrostatic attraction.

Another technique for developing electrostatic latent images is the "touchdown" process as disclosed, for example, in U.S. Pat. Nos. 2,895,847 and 3,245,823 to Mayo. In this method, a developer material is carried to a latent image bearing surface by a support layer such as a web or sheet and is deposited thereon in conformity with said image.

While ordinarily capable of producing good quality images, conventional developing materials suffer further serious deficiencies in certain areas. The developing materials must flow freely to facilitate accurate metering and even distribution during the development and developer recycling phases of the electrostatographic process. Some developer materials, though possessing desirable properties such as proper triboelectric characteristics, are unsuitable because they tend to cake, bridge, and agglomerate during handling and storage. Adherence of carrier particles to reusable electrostatographic imaging surfaces causes the formation of undesirable scratches on the surfaces during the image transfer and surface cleaning steps. The tendency of carrier particles to adhere to imaging surfaces is aggravated when the carrier surfaces are rough and irregular. In the development methods discussed above, the toner in the developer mixture can be replaced as it is used up in developing successive latent images, and the developer can be re-used in this way over a long period of time, with many thousands of images being developed. However, with prolonged use, such two component developers gradually deteriorate. In particular, owing to the collisions which occur between the toner-bearing carrier particles and the latent image bearing electrostatographic imaging surface and other parts of the electrostatographic machinery, toner particles become impacted onto the surfaces of the carrier particles, with the result that the carrier particles become less able to triboelectrically hold toner particles. This in turn leads to a tendency for the carrier particles to deposit toner particles in the background, as well as the image, areas of the latent images which are being developed. In the case of coated carrier particles, the aforementioned collisions also tend to cause the coatings to chip off the cores of the carrier particles, again leading to a reduced ability in the carrier particles to triboelectrically hold toner particles, with a consequent tendency for unwanted deposition of toner particles in the background areas of the latent images. The collisions mentioned above are especially severe and frequent in the "cascade" development method, particularly when the developer mixture is recycled by the commonly employed bucket type conveyor of the kind described in U.S. Pat. No. 3,099,943.

Eventually, the carriers in two component developer mixtures of the kind described deteriorate to such an extent that they have to be withdrawn from service. In the past the withdrawn carrier particles have frequently simply been replaced by new ones, as it has been found to be difficult to recondition the withdrawn carrier particles to produce carrier particles meeting the required specifications in a sufficiently inexpensive manner. When withdrawn, the carrier particles have on their surfaces resinous material comprising compacted toner and/or triboelectric coating material, and it is the removal of this resinous material which has provided the main difficulties. Once the resinous material has been properly removed, without substantially damaging the carrier cores, any triboelectric coating material can be replaced in the same manner as the coating was applied when making the original carrier particles.

PRIOR ART

Many methods which have been tried in the past to remove resinous material from the surface of electrostatographic carrier particles have proved to be expensive and ineffective. Consequently, it would be desirable to be able to rejuvenate electrostatographic metallic carrier particles such as coated carrier particles comprising a core of iron or steel which materials are relatively easily damaged upon heating to elevated temperatures, by being oxidized. If the cores are oxidized to any substantial extent, they are unable adequately to support a triboelectric coating. Typical prior carrier material recovery methods have included solvent washing and contact with abrasive agents to remove resinous material therefrom. However, the former method proved to be too expensive, while the latter method has been found to result in excessive damage to surfaces of the carrier cores, and this has been found to be especially troublesome in cases where the cores were to have a triboelectric coating reapplied to them, as the damaged surfaces are less able to support such a coating.

Pursuant to the teachings of U.K. Pat. No. 1,367,478, it has been found possible to rejuvenate homogeneous, inorganic, non-metallic, refractory carrier particles which have been employed in electrostatographic developer compositions of the kind comprising finely-divided electrostatographic toner particles electrostatically clinging to the carrier particles, by a "burn-off" procedure comprising heating the carrier particles at a temperature of at least 1000° F. (about 538° C.) for a period of time sufficient to restore the carrier particles to substantially their initial characteristics, and thereafter recovering the rejuvenated carrier particles.

However, it would be desirable to be able to rejuvenate electrostatographic carrier particles other than homogeneous, inorganic, non-metallic, refractory particles, especially coated carrier particles comprising a core of iron or steel which, unfortunately, are relatively easily damaged upon heating to elevated temperatures by being oxidized and by agglomerating and sintering. If the cores are oxidized to any substantial extent, they are unable adequately to support a triboelectric coating.

Another attempt to rejuvenate electrostatographic carrier particles is described in pending application U.S. Ser. No. 610,504, filed Sep. 4, 1975. The rejuvenation method disclosed therein involves heating the carrier particles to a temperature which is sufficiently high to cause the required "burn-off" of the resinous material thereon, while avoiding temperatures which would be high enough to cause damage of the carrier particle cores, the carrier particles being caused to move under the action of gravity over a supporting surface during the heating. That invention is based on the surprising discovery that, by causing the carrier particles to move under the action of gravity over a supporting surface during the heating, the temperature required for "burn-off" is significantly lower than otherwise would be the case. This is believed to be because, by causing such movement, it is possible to prevent heat-softened resinous material on the surfaces of the cores of the carrier particles from causing permanent adhesion of the carrier particles to each other or to their supporting surface at certain relatively low "burn-off" temperatures at which such adhesion or sticking would otherwise impede or prevent the required "burn-off". However, even with this measure, the tendency for carrier particles sticking during the heating step becomes increasingly marked with carrier particles of less than about 200 microns in diameter. Of course, this effect can be mitigated by increasing the "burn-off" temperature, if the cores are such that they are not damaged by practicing "burn-off" at the increased temperature, but there is only limited scope for such a measure in cases where the cores are of a material such as iron or steel which is relatively easily damaged upon heating to elevated temperatures, and it has not been found practical to use the invention of the aforementioned U.S. patent application Ser. No. 610,504 for the rejuvenation of iron or steel-cored carrier particles having a diameter on the order of about 100 microns or less, owing to such sticking and core damage problems. Therefore, there is a continuing need for the recovery and rejuvenation of carrier materials.

SUMMARY OF THE INVENTION

It is, therefore, an object of this invention to provide a method and apparatus for rejuvenating electrostatographic carrier particles which overcome the above-noted deficiencies.

It is a further object of this invention to provide an improved method and apparatus for producing recovered metallic electrostatographic carrier beads.

A further object of this invention is to provide for the rejuvenation of electrostatographic metallic carrier beads without substantially oxidizing the surface of the beads.

It is another object of this invention to provide for the rejuvenation of metallic carrier particles by removing resinous material thereform.

It is yet another object of this invention to provide for the rejuvenation of carrier materials wherein adhesion between carrier materials is avoided during their rejuvenation.

It is a still further object of this invention to provide for the rejuvenation of carrier materials having an average diameter of about 100 microns.

A still further object of this invention is to provide recovered carrier materials having physical and chemical properties superior to those of known recovered carrier materials.

The above objects and others are accomplished, generally speaking, in accordance with this invention by providing a method for rejuvenating electrostatographic carrier particles which have been employed in electrostatographic developer compositions of the kind comprising finely-divided electrostatographic toner particles electrostatically clinging to the carrier particles, the carrier particles being of the kind comprising a core and, optionally, said core having a coating of a material which modifies the triboelectric properties of the carrier particle, and, after being employed in such a developer composition, having combustible resinous material on the surfaces of the carrier particles, the method comprising heating said carrier particles in a fluidized condition.

It has been found that, when the carrier particles are in a fluidized condition, it is possible to achieve rapid heating of the carrier particles, so that, in being heated to a given burn-off temperature, they can pass through the temperature range within which carrier particle sticking problems are serious in a period of time which is relatively short, as compared with the period of time which the carrier particles would have taken to pass through that temperature range if they had been heated to the same burn-off temperature by one of the aforementioned burn-off methods proposed hitherto. This, together with the mitigating effect of the motion of the fluidized carrier particles on the problem of carrier particle sticking, means that, in general, it is possible, by using the method of the invention, to practice burn-off rejuvenation of a given type of carrier particle at a temperature which is lower than would have been possible with the aforementioned hitherto proposed burn-off methods. The use of a relatively low burn-off temperature is advantageous with all types of carrier particles, because it can lead to economy in the energy requirements of the burn-off process, and is less restrictive as regards the heat resistance properties of the materials to be employed in the construction of the burn-off apparatus. Thus, the method of the invention may be used for rejuvenating carrier particles both of the uncoated type, i.e., when new consisting of a core, but when used having resinous impurities, especially impacted toner, on their surfaces and of the coated type, i.e., when new consisting of a core and a coating of a material which modifies the triboelectric properties of the carrier particles wherein the coating, when the carrier particles have been used generally is damaged, and generally also includes impacted toner. Examples of uncoated carrier particles are the uncoated crystalline oxide carriers disclosed in U.K. Pat. No. 1,376,456, e.g., spherodized crystalline zirconium dioxide; while examples of core materials of coated carrier particles are disclosed in U.K. Patent 1,385,231 and include sand, ferrites, iron and steel. In order to give an indication of the nature of the resinous materials to be expected on the surface of used carrier particles, we would mention that examples of patent specifications disclosing toner compositions are U.S. Pat. Nos. 2,659,670; 2,753,308; 3,079,342; and 2,788,288, and that examples of coating materials which can be employed for modifying the triboelectric properties of carrier cores are disclosed in U.S. Pat. No. 2,618,551.

In cases where the carrier particles which are to be rejuvenated are capable of withstanding relatively high burn-off temperatures, such that they could be burn-off rejuvenated by one or more of the aforementioned methods which have been proposed hitherto, it can still be advantageous to practice burn-off rejuvenation by the method of the invention at such relatively high temperatures, because of the relatively fast burn-off obtainable using the method of the invention.

The method of the present invention is especially useful in cases where the carrier particles are such that rejuvenation by the above-mentioned method proposed hitherto has not been practicable or has involved difficulties, because of the small size of the carrier particles, e.g., those having an average diameter of from about 50 microns to about 150 microns, especially those from about 90 microns to about 130 microns and/or because they comprise a core of a material such as steel or iron which is relatively easily damaged upon heating to elevated temperatures. Thus, it will be appreciated that rejuvenation in accordance with this invention is especially useful in cases where the carrier particles which are subjected to the heat treatment are such that the cores thereof would be damaged if the carrier particles were heated, when static, under such conditions that said resinous material would be burnt off, and particularly useful in cases where the carrier particles which are subjected to the heat treatment are such that the cores thereof would be damaged if the carrier particles were heated, while moving under the action of gravity over a supporting surface, under such conditions that said resinous material would be burnt off.

It is generally preferred that the maximum temperature reached by the carrier particles during said heating should be from about 420° C. to about 525° C., and optionally from about 480° C. to about 520° C., so as to obtain the advantages, mentioned above, associated with the use of a relatively low burn-off temperature; and that the carrier particles are heated in the fluidized condition in a fluidized bed having a depth of not more than 5 cm, as this helps avoid difficulties which can arise in deeper beds, especially when fluidization is produced in the manner described in the next paragraph, the depth being preferably from about 3 cm to about 4 cm, as this is especially helpful in avoiding such difficulties, without unnecessarily reducing the rate at which carrier particles can be rejuvenated by the burn-off method.

The carrier particles may conveniently be fluidized by passing a combustible gas, e.g., a gas comprising a mixture of propane and oxygen, upwardly through the carrier particles, the combustible gas being burnt above the bed so as to supply heat to the bed.

It is preferred to perform the method of the invention in a continuous, rather than a batch, manner, and, in order to achieve this, to operate the method so that carrier particles which can be subjected to the heat treatment are continuously added to a fluidized body of carrier particles which are undergoing the heat treatment, and carrier particles which have undergone the heat treatment are continuously withdrawn from the body.

In order to permit the burn-off to be completed satisfactorily, the carrier particles should not be withdrawn from the fluidized body too soon after they are introduced into it, and we have found that, in general, this necessitates that the mean residence time spent by the carrier particles while being heated in the fluidized condition is at least about 2 minutes. In the case where the carrier particles are continuously added to, and withdrawn from, a fluidized body as described above, the carrier particles should desirably be added to the fluidized body at a rate of less than about 1¼ kg/sec/$m^2$ of cross-sectional area of the fluidized body, preferably not greater than about 1 kg/sec/$m^2$.

It will be appreciated that it is desirable to minimize the spread in the residence time of individual carrier particles so as to avoid a situation in which some carrier particles have a residence time substantially less than the mean residence time. The greater the spread in residence times, the greater is the risk that some carrier particles will be subjected to the heating for a period of time insufficient to permit completion of the burn-off, and therefore the longer is the mean residence time required to minimize this risk.

When carrier particles are continuously added to, and withdrawn from, a fluidized body of carrier particles as described above, the behavior of the particles is moving from the point at which they are withdrawn therefrom will, in practice, fall between two extremes. The first of these extremes, "perfect mixing", is where the particles become perfectly mixed in, or distributed through, the fluidized body as soon as they are introduced therein. In such a case, a small proportion of particles would appear at the point at which the carrier particles are withdrawn from the fluidized body virtually immediately, and the arrival of carrier particles at this point would continue over a long period of time, the rate of arrival initially increasing with time to a peak, and then falling off gradually. The second extreme, "plug flow", is described as where the particles which are introduced into the fluidized body do not mix with the remaining particles at all, but move together with their neighbors directly to the point at which the particles are removed from the fluidized body. In such a case the time taken for each carrier particle to complete this journey, the residence time, is the same. From the foregoing, it will be appreciated that, from the point of view of residence time, one should try to get as close as possible to plug flow. However, fluidized beds are known to be extremely good mixing devices, and unless effective precautions are taken their use will tend to result in an undesirably large spread in residence times with a consequent need for an undesirably long mean residence time. One solution to this problem is to reduce the extent to which mixing can occur by splitting the fluidized body into a series of relatively isolated bodies, i.e. to employ a multi-stage fluidized bed.

For the sake of simplicity, it is preferable to operate the method of the invention so that the carrier particles are heated in the fluidized condition in a single fluidized bed, and it is possible to reduce the spread in residence times which occurs in single beds by suitably positioning a baffle in the fluidized body so as to make the shortest path between the point at which a carrier particle is added to the fluidized body and the point at which it leaves the fluidized body longer than it otherwise would be. Greater reductions in the spread in residence times can be achieved by employing more than one baffle. Of course, baffles can be employed with multistage fluidized beds as well, if desired.

The present invention also includes apparatus for rejuvenating electrostatographic carrier particles by removing combustible resinuous material from the surfaces thereof, the carrier particles having been employed in electrostatographic developer compositions of the kind comprising finely-divided electrostatographic toner particles electrostatically clinging to the carrier particles, being of the kind comprising a core and, optionally, having a coating of a material which modifies the triboelectric properties of the carrier particles, and, after being employed in such a developer composition, having combustible resinous material on the surface of the core, the apparatus comprising: fluidizing means for fluidizing such carrier particles; the apparatus being arranged so that such carrier particles, when fluidized by said fluidizing means, can be heated under such conditions that said resinuous material can be burnt off; the apparatus including removal means for removing carrier particles which have been fluidized by said fluidizing means and heated as aforesaid, after the resinous material thereof has been burnt off; and supply means for supplying the aforesaid kind of carrier particles to be rejuvenated to said fluidizing means so that they can be fluidized thereby and heated as aforesaid, said supply means being so positioned and arranged to operate that, when the rejuvenating apparatus is in operation, the supply means can supply the aforesaid kind of carrier particles to be rejuvenated with substantially no sticking of the carrier particles being supplied to each other or to the apparatus. It has been found that the latter requirement is an important one, because, once the supply means permits carrier particle sticking to begin, the amount of sticking rapidly increases, and soon interferes with the rejuvenation, for example by cutting off the carrier particle supply.

The temperature at which typical carrier particles having resinous material on their surfaces become detectably sticky is in the range 70° C. to 80° C. In view of this, the supply means should generally be so positioned and arranged to operate that carrier particles being supplied thereby will not come into contact with a surface at a temperature above 70° C., and preferably should be so positioned and arranged to operate that carrier particles being supplied thereby will not come into contact with a surface at a temperature above 50° C.

In one arrangement of the supply means for substantially avoiding carrier particle sticking, the supply means comprises conduit means arranged so that, when the apparatus is operating, they can discharge the aforesaid kind of carrier particles to be rejuvenated, by gravity, into a body of carrier particles fluidized by said fluidizing means, and said conduit means is positioned sufficiently far above said fluidized carrier particles so that the amount of heat reaching said conduit means from said fluidized carrier particles and the source or sources of heat therefor is insufficient to cause sticking of the carrier particles being supplied, to each other or to the apparatus.

In an alternative arrangement, the supply means comprises conduit means arranged so that when the apparatus is operating, they can discharge the aforesaid kind of carrier particles to be rejuvenated into a body of carrier particles fluidized by said fluidizing means, said conduit means including heat transfer means arranged to operate so as to remove heat from said conduit means so as to prevent sticking of the carrier particles being supplied to each other or to the apparatus.

A form of apparatus in accordance with the invention which has been found to be efficient and effective is one in which the fluidizing means is supplied with a combustible gas and, in operation, fluidizes carrier particles by passing the gas upwardly through the carrier particles, the apparatus being arranged so that the gas can be burnt above the fluidized particles so as to supply heat directly to the fluidized particles.

The apparatus may include auxiliary heating means for supplying heat to the fluidized particles additional to that supplied directly by combustion of the combustible gas. Such auxiliary heating means may comprise means for passing the combustible gas which is to be supplied to the fluidizing means in heat exchange relationship with the products of the combustion above the fluidized particles and/or, when as will normally be the case, the fluidized particles are laterally confined by wall means, they may comprise means to heat the wall means.

With the aforementioned preferred form of apparatus employing combustion of the fluidized gas, it is preferred, for the sake of safety, to include a pilot ignition device positioned and arranged to operate so that, when the pilot device is operating, combustible gas which has been passed by the fluidizing means upwardly through the carrier particles will be ignited by the pilot ignition device, and detector means to detect whether or not the pilot ignition device is operating, the detector means being arranged to cut off the supply of combustible gas to the fluidizing means in the event that the pilot ignition device ceases to operate.

It is also preferred with that form of apparatus to include monitor means to monitor the temperature of carrier particles which have been fluidized and heated as aforesaid, the monitor means being arranged to operate so that, when the temperature of the carrier particles exceeds a certain value, the supply of combustible gas to said fluidizing means will be cut off and a supply of non-combustible gas will be substituted to maintain fluidization of the carrier particles, and so that, when the temperature of said carrier particles falls below a certain value, the supply of non-combustible gas will be cut off and the supply of combustible gas will be restored.

In order to enable the apparatus to be operated in a continuous manner, as is preferred, the supply means are preferably arranged to supply carrier particles in a continuous manner, the removal means being arranged to remove carrier particles in a continuous manner also. A preferred form of supply means comprises hopper means having an output terminating adjacent to a channel which is inclined so that carrier particles deposited thereon from the output are led by the channel to be supplied to the fluidizing means, the channel means being arranged so that the inclination thereof can be adjusted, so that the rate of flow of carrier particles from the output can also be adjusted.

It has been found to be very conducive to efficient operation for the apparatus to be arranged to operate so that the carrier particles which are fluidized by the fluidizing means and heated are in a fluidized bed of substantially uniform, constant depth, desirably less than 5 cm, and preferably from 3 cm to 4 cm. In such cases, the removal means is preferably of a form comprising an output conduit having an inlet situated at a distance above the bottom of the bed such that the required bed depth can be maintained.

In cases where it is desired to regulate the output of the apparatus, for example where it is desired to damp the effect on the output of surges in input, the removal means may comprise an output tube, and a tapering member supported at the output end of the output tube so as to be insertable into and withdrawable from the output tube so as to provide a variable annular gap between the tapering member and the output tube.

After a considerable amount of experimentation and testing it has been found to be desirable that the fluidizing means should comprise a distributor plate of the porous mesh type, and also that the fluidizing means should comprise a distributor plate which is removably sealed to the apparatus by alumina cement.

In order that the invention may be more fully understood, some preferred embodiments in accordance therewith will now be described, with reference to the accompanying drawings, in which:

FIG. 1 is a diagrammatic, partial, sectional view of an apparatus, in accordance with the invention, for rejuvenating electrostatographic carrier particles;

FIG. 1A is a view, on an enlarged scale, of a detail of FIG. 1;

Figure 2:
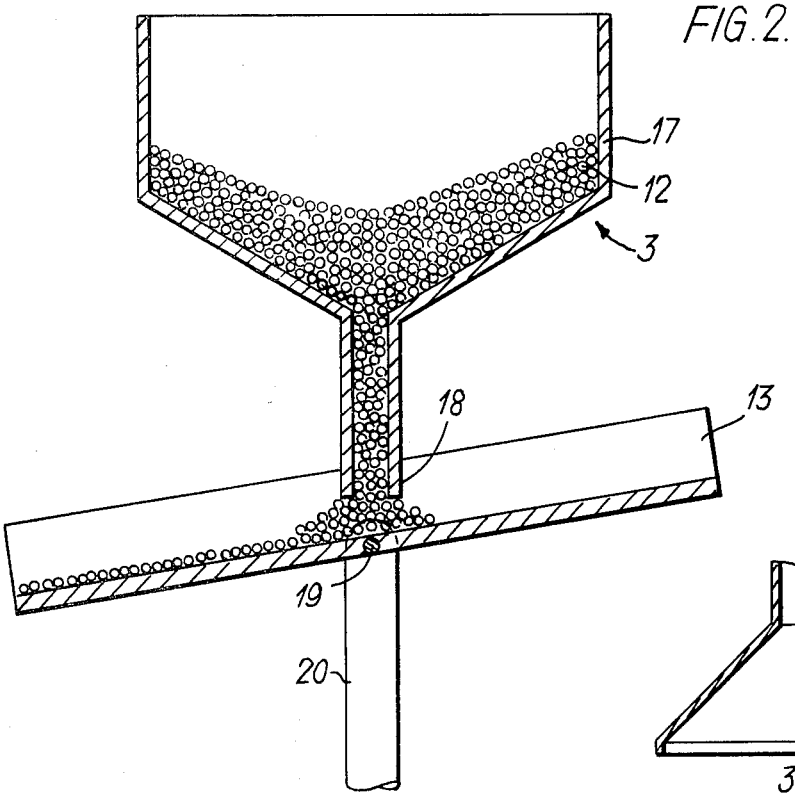
FIG. 2 is a diagrammatic, partial, sectional view, on an enlarged scale, of a modified form of the supply means of the apparatus shown in FIG. 1.

Referring firstly to FIG. 1, the apparatus shown therein comprises:

(a) fluidizing means, shown generally at 1;

(b) removal means, shown generally at 2; and (c) supply means, shown generally at 3.

The fluidizing means 1 comprises a reaction chamber 4, which is arranged to operate as a single stage fluidized bed, a wind box 5, and a gas supply system shown partially at 6. A distributor plate 7 is sandwiched between the reaction chamber 4 and the wind box 5, these items being held together in a dismantlable manner. The reaction chamber 4 and wind box 5 are of cylindrical form.

It is important that a smooth, leak-tight seal 8 (shown diagrammatically on an enlarged scale in FIG. 1A) should be produced in the region of the junction of the reaction chamber 4, wind box 5 and distributor plate 7. The material employed should also be such as to permit the sandwich arrangement to be dismantled, in case the need should arise to replace the distributor plate 7. It has been found that these criteria can be met by employing a high alumina cement, e.g. "Alumina Cement Refractory Cement" supplied by Thermal Syndicate Ltd., of Wallsend, Northumberland, United Kingdom.

As will be appreciated from the following further description of the apparatus and its operation, it is highly desirable that the distributor plate should be able:

(1) to support the weight of a bed of carrier particles, (a) to prevent carrier particles from such a bed from flowing downwards into the wind box 5, (3) to promote rapid particle movement throughout the bed and at the plate, (4) to withstand the temperature difference between that in the wind box 5, which is generally ambient and that of the bed of carrier particles thereabove which is generally about 500° C., in the case where the carrier particles to be rejuvenated are steel-cored, (5) to distribute the gas uniformly over the bed cross-section;

(6) to operate with as low a pressure drop across the distributor plate as is compatible with (1) to (5);

(7) to operate for long periods without blocking or generating dead or hot spots due to localized overheating;

(8) to produce small bubbles so that violent motion in the surface of the bed can be avoided; and (9) to resist any tendency for the fluidizing gas passing through it to blow back into the wind box.

After extensive testing, it has been found that when the carrier particles to be rejuvenated are steel-cored and have particle diameters on the order of about 100 microns, these criteria can best be met with a porous mesh type of distributor plate such as stainless steel plate available under the description "Porosint Rigi Mesh Type RM 2½" from Sintered Products Ltd., Hamilton Road, Sutton-In-Ashfield, Nottinghamshire, United Kingdom.

The gas supply system 6 comprises a duct 9 connected to one end of the wind box 5 and at the other end both to a duct 10 for supplying propane gas and to a duct 11 for supplying a gas comprising oxygen, which conveniently may be compressed air. At its end remote from the duct 9, duct 10 is connected to a source, e.g., a cylinder, of propane gas (not shown), and the duct 10 includes an on/off valve, a pressure regulating valve, a variable flowmeter, an automatic flow control valve and a non-return valve, none of which are shown. Similarly, duct 11 is connected, at its end remote from the duct 9, to a compressor (not shown), which supplies compressed air, and the duct 11 includes an on/off valve, a pressure regulating valve, a variable flowmeter, an automatic flow control vavle and a non-return valve, none of which are shown. The ducts 10 and 11 may include other flow-regulating aids, as required. It will be seen that the junction of the ducts 9, 10 and 11 acts as a mixer for the propane and air, so as to cause a combustible gas comprising a mixture of propane and oxygen, in properly regulated proportions, to enter the wind box 5 and to pass upwardly through both the distributor plate 7, and when the apparatus is in operation, the bed of carrier particles, so as to fluidize the latter, so that the propane/air mixture can then be burnt above the fluidized bed.

The supply means 3 is arranged to supply carrier particles 12 which are to be rejuvenated to the reaction chamber 4 in a continuous or, if desired, batch manner, and comprises a channel 13 which is inclined towards the reaction chamber 4 so that carrier particles 12 deposited on the channel 13 will flow under the forces of gravity to the lower end of the channel 13, and thence will fall into the reaction chamber 4. As will be seen from FIG. 1, the vertical distance of the channel 13 from the fluidized bed shown at 14 is relatively large. In fact, it is sufficiently large to ensure that the amount of heat reaching the channel 13 from the source or sources of heat, for the fluidized bed 14 is insufficient to cause sticking or carrier particles 12 which are being supplied by the supply means to each other or to the apparatus.

The removal means 2 comprises an outlet duct 15 which is positioned so that, in use of the apparatus, when carrier particles are added to the fluidized bed 14, carrier particles which are near to the outlet duct 15 will be displaced into the duct 15 to flow out of the apparatus. Thus, when carrier particles are supplied by the supply means 3 in a continuous manner, carrier particles are removed by the removal means also in a continuous manner, and, so long as the rate of supply is steady and is not excessive, the output rate matches the rate of input, and the depth of the fluidized bed is substantially equal to the vertical distance of the base of the inlet portion of the outlet duct from the distributor plate 7, assuming that the upper surface of the distributor plate 7 is flat and horizontal, as is very much preferred, so that the fluidized bed 14 will be of substantially uniform, constant depth.

It has been found, somewhat surprisingly, that it is important that the depth of the fluidized bed 14 should not be too great, since otherwise it is difficult, if not impossible, to maintain a stable flame above the fluidized bed 14. For this reason, this depth, i.e., the aforementioned vertical distance, should in general be less than 5 cm, and it is preferred that this depth should be from 3 cm to 4 cm. It is believed that the flame instability which occurs with excessive bed depths is caused by quenching of the flame by relatively cold carrier particles from the fluidized bed 14.

It is also desirable for the apparatus to include an exhaust duct such as that indicated at 16, and such a duct preferably includes a waste gas cleaner (not shown) comprising one or more cyclones followed by a wet scrubber.

Referring now to FIG. 2, the modified form of supply means 3 shown therein includes, in addition to the inclined channel 13, a hopper 17 having an output 18 terminating adjacent to the channel 13. Also, the channel 13 is pivotted about a pivot 19, which is mounted at each of its ends in supports, part of one of which is shown at 20, the two supports being arranged frictionally to engage the channel 13 so that the inclination of the latter can be adjusted manually from one of a plurality of frictionally held settings to another such setting, whereby the rate of flow of carrier particles from the output 18, and thus also from the channel 13 into the fluidized bed 14, can also be adjusted. If the internal cross-sectional area of the hopper 17 is sufficiently large, the latter rate of flow can be substantially constant for a given setting of the inclination of the channel 13. Further scope for adjusting this flow rate can be provided by arranging for fine adjustment of the vertical separation between the output 18 and the channel 13.

Figure 3:
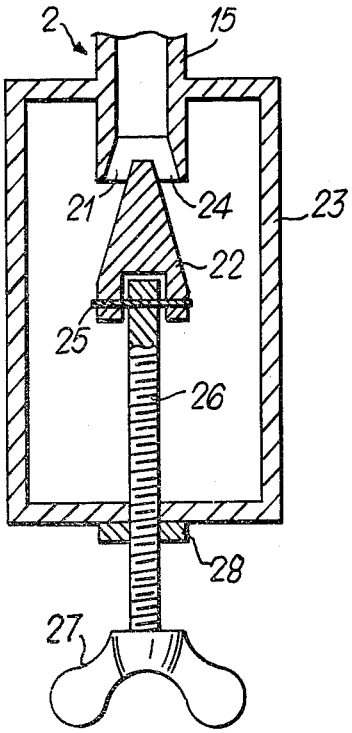
FIG. 3 is a diagrammatic, partial, sectional view, on an enlarged scale, of a modified form of the removal means of the apparatus shown in FIG. 1.

The removal means 2 shown in FIG. 3 is a modification of that shown in FIG. 1, in that the output duct 15 thereof, which is in tube form, has a frusto-conical valve seat 21 at its output end, and in that a tapering member 22, of generally cylindrical form, is supported in a frame 23 at the output end of the outlet duct 15 so as to provide a variable annular gap 24 between the outlet duct 14 and the tapering member 22. This is achieved by linking the tapering member 22, by means of a pin member 25, to a threaded support member 26 which is threadedly supported in the frame 23, the pin member 25 being a force fit in the tapering member 22 and a push fit in the threaded support member 26. The latter is adapted for rotation, for example by the provision of a wing nut 27 fixed thereto by welding, and, upon such rotation, the annular gap 24 can be adjusted owing to the relative motion between the valve seat 21 and the tapering member 22. At one extreme of the motion of the tapering member 22, it is substantially completely withdrawn from the vicinity of the outlet duct 15, and at the other extreme it is firmly seated in the valve seat 21, the manner of the mounting of the tapering member 22 on the threaded support member 26 permitting compensation for misalignment of the axis of the latter with that of the valve seat 21. If such misalignment is not likely to occur, the tapering member 22 may be mounted on the threaded support member 26 in such a manner that it is integral therewith. A lock nut 28 is provided to enable such setting of the tapering member 22 to be retained securely.

Figure 4:
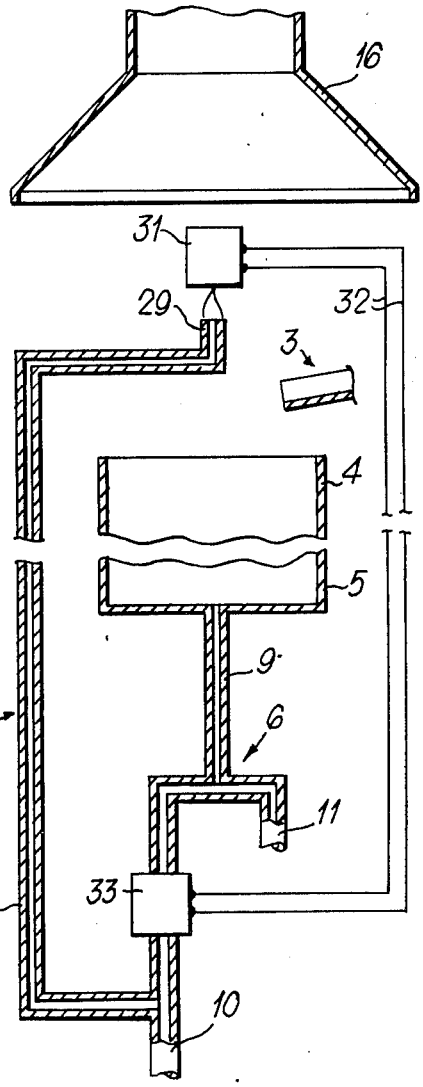
FIG. 4 is a diagrammatic, partial, sectional view of a pilot ignition device which may be employed in the apparatus shown in FIG. 1.

It is preferred to include a pilot ignition safety device as shown diagrammatically in FIG. 4. This device comprises a pilot burner 29 which is fed with propane gas from the duct 10 through a duct 30 and which is positioned so that it can ignite the initial propane/air fluidizing gas after it has risen through the bed of carrier particles, and can re-ignite the fluidizing gas in the event that the flame is extinguished for any reason. A thermostatic detector 31 is positioned so as to be in thermal contact with the flame of the pilot burner 29 and is electrically connected through leads 32 to a solenoid valve 33. The detector 31 and valve 33 are arranged to cooperate so that in the event that the flame of the pilot burner 29 goes out, the detector 31 as a result of the consequent drop in its temperature causes the valve 33 to close thereby cutting off the supply of propane to the duct 9. Conversely, on lighting or relighting the pilot burner 29, the detector 31 is heated up and then causes the valve 33 to open so as to permit propane gas to flow from the duct 10 to the duct 9.

Figure 5:
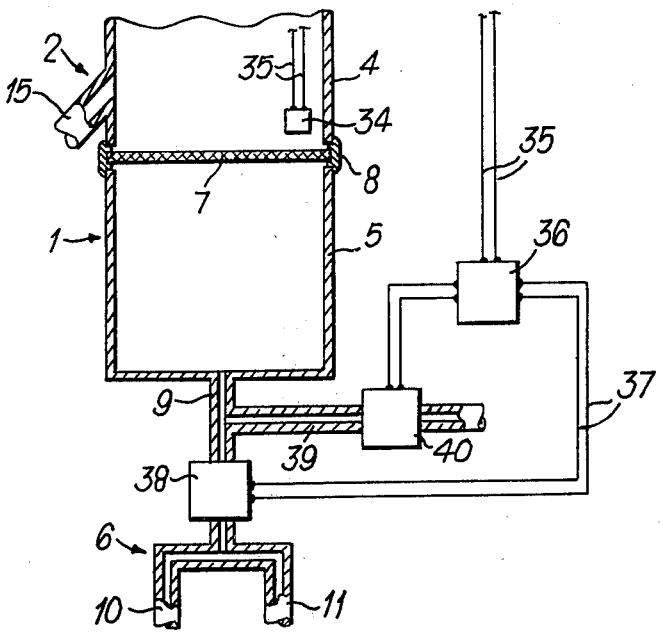
FIG. 5 is a diagrammatic, partial, sectional view of a monitor means which may be employed in the apparatus shown in FIG. 1.

In FIG. 5 the main component of the monitor means shown therein is a temperature detector 24 in the form of a thermocouple which is positioned so that it will be in thermal contact with the fluidized carrier particles, and which is connected by thermally insulated leads 35 to a control device 36 which is in turn connected by leads 37 to a solenoid valve 38 at the inlet end of the duct 9. The purpose of this arrangement is to secure that should the temperature of the fluidized carrier particles rise to a maximum over which it is desired that it should not exceed, e.g., 520° C. in the case of carrier particles having a steel core, the flame above the fluidized bed will be extinguished. With this purpose in view, the control device 36 is arranged to cooperate with the valve 38 so that it closes the latter when such a temperature is detected by the detector 34 thereby cutting off the propane/air supply in the duct 9. It is very much preferred that, in the event it becomes necessary to cut off the propane/air supply, fluidization of the carrier particles will nevertheless be maintained, and for this purpose there is provided a duct 39 connected at its inlet end to a source (not shown) of a non-combustible gas, e.g., nitrogen, and at its outlet end to the duct 9, downstream of the valve 38. Duct 29 includes a solenoid valve 40, which is connected by leads 41 to the control device 36 which is arranged to cooperate with the valve 40 so that, in the event that the control device 36 causes the valve 38 to close such as when the temperature of the fluidized carrier particles rises above a preset maximum shutting off the propane/air supply, the control device 38 simultaneously causes the valve 40 to open thereby turning on the nitrogen supply so that fluidization of the carrier particles can be maintained. Conversely, the control device is also arranged to operate so that when the temperature of the fluidized carrier particles, as detected by the detector 34, falls to a preset minimum, e.g., 480° C. in the case of carrier particles having a steel core, the valve 40 will be closed and the valve 38 will be reopened, so that the carrier particles will once again be fluidized by the propane/air mixture. With this arrangement, it is highly desirable to include a pilot light employing, for example, the arrangement shown in FIG. 4 so that the propane/air fluidizing gas will then be re-ignited.

Figure 6:
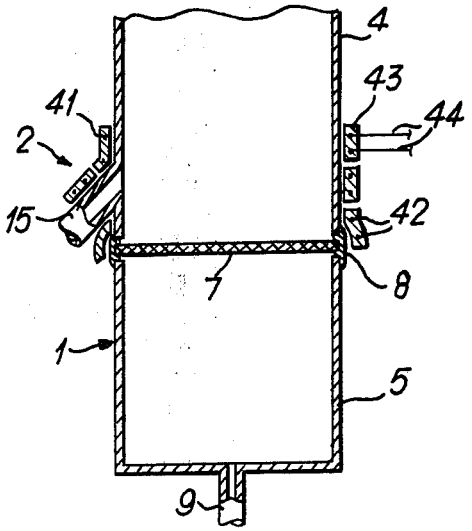
FIG. 6 is a diagrammatic, partial, sectional view of an auxiliary heating means which may be employed in the apparatus shown in FIG. 1.

FIG. 6 depicts an optional auxiliary heater 41 for supplying heat to the fluidized carrier particles additional to that supplied directly by combustion of the propane/air fluidizing gas. It has been found that, in practice, once the apparatus is operating under equilibrium conditions, sufficient heat for the burn-off rejuvenation of carrier particles can be provided by the combustion of the propane/air fluidizing gas since the burn-off reactions themselves are exothermic overall and the heater 41 will normally be used only during start-up of the apparatus while it is reaching equilibrium conditions. In fact, it has been calculated that with some types of carrier particles, the burn-off reactions themselves could almost, in the substantial absence of heat losses, provide sufficient heat for continuous burn-off even allowing for the fact that the product carrier particles will normally be at the temperature at which the burn-off reaction takes place such as generally about 500° C. in the use of steel-cored carrier particles. However, if high carrier particle treatment rates are required, one can employ an auxiliary heater such as the heater 41 throughout the operation of the apparatus. It will be appreciated that there is a limit to the extent to which one can increase the rate of supply of heat to the fluidized bed 14 by increasing the rate of flow of the propane/air mixture, because too high a rate of flow will result in slugging, as is described later. The heater 41 is in the form of a flexible strip wound about the reaction chamber 4 in the zone which is to accomodate the fluidized bed of carrier particles, and comprise electrical resistance heating elements 42 embedded in flexible, electrical insulating, thermally conductive material 43, and connected by leads 44 to a source (not shown) of electrical power.

Figure 7:
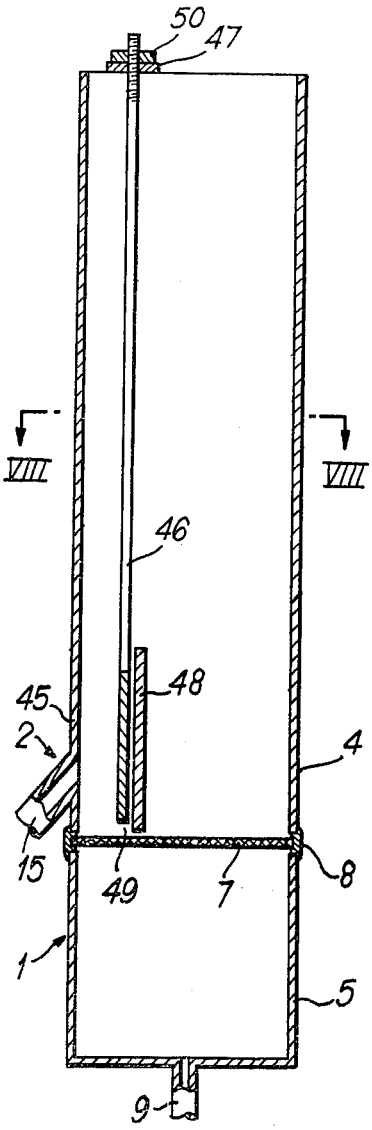
FIG. 7 is a diagrammatic, partial, sectional view of the apparatus of FIG. 1, showing a baffle which may be employed therein.
Figure 8:
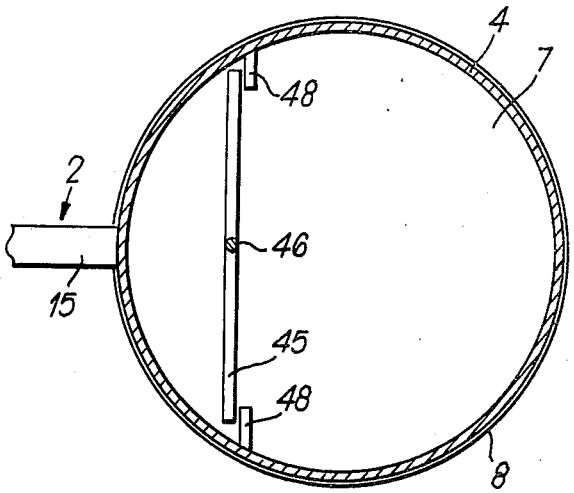
FIG. 8 is a diagrammatic, partial, sectional view, on an enlarged scale, taken along the line VIII—VIII of FIG. 7.

In FIGS. 7 and 8, there is shown a baffle plate 45 whose use is very much preferred, but is not essential. The baffle plate 45 is integrally connected to a rod 46, which passes at its upper end through a horizontal supporting member 47, which in turn is attached to the reaction chamber 4 at its upper end, passing across a chord thereof, as viewed from above. As will be seen from FIG. 8, the baffle plate is held in position inside the reaction chamber 4 across a chord thereof by runner members 48, which are welded inside the reaction chamber 4, and which are arranged to permit the baffle plate 45 to be moved in a vertical plane. In order to enable movement of the baffle plate 45 in that vertical plane, for the purpose of adjusting the size of the vertical gap 49 between the bottom of the baffle plate 45 and the distributor plate 7, the rod 46 is threaded at its upper end to take a nut 50. The vertical height of the baffle plate 45 is sufficiently great so that, in operation of the apparatus, fluidized carrier particles cannot jump over the top of the baffle plate.

In use of the apparatus described above with reference to the accompanying drawings, an initial charge of uncoated carrier particle cores is placed in the reaction chamber 4 so as to fill it to almost the base of the inlet of the outlet duct 15. This initial charge of carrier particle cores should be free of resinous material so as to avoid carrier particle sticking problems during warm-up of the apparatus. Normally, carrier particles which have been rejuvenated by previous operation of the apparatus will be used.

The propane and compressed air supplies are then turned on, the respective flow rates being set so that the proportion of oxygen in the resulting mixture flowing through the duct 9, wind box 5, distributor plate 7 and bed of particles 12 is slightly in excess of the amount required for combustion of the propane, and so that the rate of flow of the propane/air mixture upwardly through the bed of particles causes fluidization thereof. The propane/air mixture is lit so that it burns above the fluidized bed of particles, and the particles begin to heat up. If desired, auxiliary heating means, such as the auxiliary heater 41 shown in FIG. 6, can be employed so as to reduce the time it takes to heat the particles to the required burn-off temperature such as 500° C. ± 20° C. in the case of steel carrier particle cores.

At this point, it is appropriate to outline the sequence of events which takes place when one passes a fluidizing gas upwardly through a distributor plate such as plate 7 and a bed of particles such as particles 12 supported thereon and contained in a cylindrical housing such as reaction chamber 4, the rate of flow of gas being continuously increased from an initially low level. First, the bed expands from a fixed bed to the point of incipient fluidization, and then, as the flow rate is further increased, bubbling begins. At this stage, provided that the distributor plate is functioning correctly so that the fluidizing gas is issuing from it uniformly across its whole area, substantially the whole of the weight of the bed is supported by the fluidizing gas, bubbles of fluidizing gas are rising through the fluidized bed, and the behavior of the bed as a whole appears similar to that of gently boiling liquid. At the flow rate continues to increase, bubbling continues with the size and frequency of the bubbles increasing. Eventually, a stage is reached where the frontal diameters of the bubbles are equal to the diameter of the cylindrical tube. At this stage, severe fluctuations in the level of the bed occur, and the bed is said to be slugging.

Once fluidization has been initiated, the fluidized bed 14 should be kept in a bubbling condition as indicated diagrammatically in FIG. 1, and slugging should be avoided. As the bubbling fluidized bed 14 warms up, the size of the bubbles increases, and it is usually necessary to cut back on the rate of flow of the fluidizing propane-/air mixture in order to keep the bubble size a safe amount lower than that at which slugging occurs. It should also be noted that the velocity of the fluidizing gas should not be sufficiently great to cause entrainment of particles 12. However, in practice, the problem of particle entrainment is unlikely to occur with a fluidized bed which is merely bubbling.

As the fluidized bed 14 warms up, the auxiliary heating, if any, is withdrawn, and the gas flow rates are adjusted so that a situation is reached where the fluidized bed 14 is in a bubbling condition at the temperature required for the subsequent burn-off such as about 500° C. for steel-cored particles, the rate of flow of air being such that there is an excess proportion, such as about 10%, of oxygen present over the stoichiometric proportion required for the complete combustion of the propane, this excess being required to enable the burn-off of the resinous material on the carrier particles which are to be rejuvenated to take place under conditions which are not oxidizing to an unnecessary degree. At this stage, the introduction of the carrier particles, usually with free toner particles electrostatically adhering thereto from the supply means 3 is commenced, and resinous material-free carrier particles, i.e. carrier cores, begin to exit through the removal means 2. Initially, it may be necessary to adjust the gas flow rates while the final equilibrium is being reached, and to reach the final rate of supply of carrier particles by gradually increasing an initially relatively low supply rate, but, once the introduction of carrier particles is commenced, stable, continuous operation of the apparatus can soon be reached. The final rate of supply of carrier particles is made as high as possible consistent with there being an adequate residence time for all of the carrier particles, as discussed above. Preferably, this rate of supply is not greater than about 1¼ Kg/second/$m^2$ of distributor plate 7. With such a rate of supply, it is generally possible to ensure that the mean residence time of the carrier particles is at least 2 minutes.

The burn-off rejuvenated carrier particles, i.e., carrier cores, which continuously flow out through the removal means 2 at approximately the temperature of the fluidized bed 14, are allowed to cool, and may, if necessary, be subjected to further treatment, to remove loose contaminants.

Where the carrier particles originally included a resinous coating to modify their triboelectric properties, this coating can then be reapplied, in the same manner as it was applied originally or in any other suitable manner. Of course, if desired, one can apply a different type of triboelectric coating, and one can apply such a coating to rejuvenated carrier particles which originally were not so coated, or one can use, in an uncoated form, rejuvenated carrier particles which originally did have such a coating, provided, in each case, that the rejuvenated carrier particles have the triboelectric properties required for their new intended use.

The following Example describes, by way of example only, a rejuvenation method in accordance with the invention.

EXAMPLE

The apparatus described above with reference to FIGS. 1 and 1A of the accompanying drawings, and incorporating the modifications described with reference to FIGS. 2 to 4 and 6 to 8, was used in the manner described above to rejuvenate the carrier particles of a cascade type of electrostatographic developer which had been supplied by Rank Xerox Limited, England, under the designation "5R 90033". This developer consisted of fine particles of toner electrostatically clinging to the surfaces of steel-cored carrier particles, the toner comprising a bisphenol fumarate polyester and a carbon black pigment, and the carrier particles having approximately 0.4% by weight of a triboelectric coating material comprising a terpolymer of methyl methacrylate, styrene and vinyl triethoxysilane approximately in the weight ratio 17:3:1. The developer has been used to develop approximately 300,000 electrostatographic latent images in a commercial electrostatographic copying machine employing "cascade" development employing a bucket conveyor. The diameters of substantially all of the carrier particles fell within the range 63 microns to 180 microns. With these carrier particles, appreciable stickiness, i.e., stickiness which could lead to sticking problems if the particles were allowed to remain static appeared at about 70° C. to 80° C., and the temperature at which stickiness became no longer appreciable was approximately 250° C. Preliminary tests showed that, with these carrier particles, attempts to practice the method of the invention using a fluidized bed temperature of about 600° C. resulted in an unacceptable degree of oxidation and particle sintering and agglomeration.

The main components of apparatus employed (reaction chamber 4, baffle plate 45, inlet channel 13, wind box 5, removal means 2, etc.) were of mild steel, and the distributor plate 7 was 177$cm^2$ in area, and was of "Porosint Rigi Mesh Type RM 2½" described above, and was sealed with "Alumina Cement Refractory Cement", also as described above. Important dimensions were as follows:

1. Diameter of reaction chamber 4 = 15 cm
2. Height of reaction chamber 4 = 50 cm
3. Vertical distance of the base of outlet duct 15 above the distributor plate 7 (i.e. the depth of the fluidized bed 14) = 3.3 cm 4. Width of the baffle plate 45 = 13 cm
5. Height of the baffle plate 45 = 14.5 cm
6. Vertical height of the gap 49 = 1.5 cm The apparatus was started up in the manner generally described above, however, initially using as the feed uncoated carrier cores which had been obtained from similar used carrier particles, during previous operation of the apparatus, and then adding the used carrier particles which were to be treated and which had some free toner electrostatically adhering thereto, initially at a relatively low rate which was increased until stable continuous operating conditions were achieved. The heater 41 was used only during the warm-up period.

When stable, continuous operation of the apparatus had been achieved, the following conditions pertained:

1. Temperature of the fluidized bed 14: about 500° C.
2. Flame temperature of the burning propane: within the range from 800° C. to 900° C.
3. Volume ratio of rate of flow of air: rate of flow of propane (rates measured at the same pressure): about 27:1
4. Fluidizing gas velocity:
(a) when at 20° C. = 13.6 cm/sec.
(b) in the bed = 35.8 cm/sec.
5. Rate of flow of carrier particles through the apparatus = 1 Kg/min ($\simeq$1 Kg/sec/m$^2$ of distributor plate 7)
6. Mean residence time of particles in the fluidized bed 14: about 2½ min.
7. Minimum residence time of particles in the fluidized bed: somewhat under 2 min.

Samples of the rejuvenated carrier particles product, i.e. carrier cores, were analyzed for organic coating material: none was found. Further samples were compared with samples of the core particles of the kind employed in making the "5R 90033" developer, the latter particles never having been coated. A scanning electron microscope (SEM) was used, and no significant differences in the surface texture of the two types of particles were detected.

As will be clear to those skilled in the art, many additions and modifications may be made, within the scope of the present invention, to the apparatus described above with reference to the accompanying drawings. For example, in order to enable the rate at which heat is received by the fluidized bed 14 to be increased, for example, to allow the rate of flow of carrier particles through the apparatus to be increased, one can either instead of, or as well as, including means to heat the reaction chamber 4 such as the heater 41 shown in FIG. 6, lag the reaction chamber 4 and/or arrange for the products of the combustion above the fluidized bed 14 to be passed in heat exchange relationship with the fluidizing gas, for example by arranging that the combustion products passing through the exhaust duct 16 should pass through a heat exchanger which is arranged to pass heat to the gases passing through duct 9.

Also, the apparatus may be equipped with additional instrumentation to aid in its efficient operation, and also to enable the operator to monitor the effects of experimental changes in the manner of operation of the apparatus. For example, it has been found helpful in the researches so far conducted on the apparatus, to include a manometer to measure the pressure difference between the interior of the wind box 5 and various positions on the opposite side of the distributor plate 7. For this purpose, a duct which was in communication with the interior of the wind box 5 was connected to one side of a water manometer, the other side being connected to a stainless steel probe having at its tip a small hole protected by a stainless steel mesh, the probe being arranged so that its tip could be positioned at any desired depth in the fluidized bed 14.

In some cases it may be found desirable to include heat transfer means in the supply means 3, for example, a water cooling duct in the channel 13, to avoid particle sticking problems there. Such an arrangement might be desirable, for example, when it is not possible to accomodate a sufficiently tall reaction chamber 4.

When relatively large quantities of carrier particles are to be rejuvenated, it may be desirable to enlarge the apparatus. The main modification required for this purpose is to enlarge the diameter of the reaction chamber 4, distributor plate 7, and wind box 5. In doing so, it is necessary to ensure that the enlarged distributor plate 7 employed will not sag to any substantial extent under the weight of the bed of carrier particles, and that it is not mounted out of the horizontal. Failure to attend to either of these points can lead to an unsatisfactory non-uniformity of the fluidized bed depth. In larger apparatus, it may be necessary to arrange for the feed from the supply means 3 to enter the reaction chamber 4 at several different points, so as to avoid excessive localized cooling of the fluidized bed at the feed point or points.

The apparatus of the present invention can readily be arranged to run atuomatically. In such cases, it is desirable to arrange various alarms to warn of abnormal running conditions. For example, such alarms may warn of:

(a) an undesirably low or high temperature in the fluidized bed 14 as detected by the detector 34, for example;
(b) an excessively high temperature in the wind box 5;
(c) a low level in the hopper 17; and/or
(d) an abnormal pressure drop across the distributor plate 7.

What is claimed is:

1. A method for rejuvenating electrostatographic carrier particles which have been employed in electrostatographic developer compositions of the kind comprising finely-divided electrostatographic toner particles electrostatically clinging to the carrier particles, said carrier particles comprising a metal core having combustible resinous material on the surface thereof, the method comprising fluidizing said carrier particles by passing a combustible gas and air mixture upwardly through a bed of said carrier particles, and heating said carrier particles in a fluidized condition to a temperature of from between about 420° C. and about 525° C. by burning said combustible gas and air mixture above said bed until said combustible resinous material on the surface of said core is removed, said core metal being selected from the group consisting of iron and steel, and said heating of said carrier particles being performed in the presence of a stoichiometric excess of oxygen with respect to the proportion of oxygen required for complete combustion of said combustible gas.

2. A method for rejuvenating electrostatographic carrier particles in accordance with claim 1 wherein said combustible gas comprises propane.

3. A method for rejuvenating electrostatographic carrier particles in accordance with claim 1 wherein said carrier particles have an average diameter of from about 50 microns to about 150 microns.

4. A method for rejuvenating electrostatographic carrier particles in accordance with claim 1 wherein said carrier particles have an average diameter of from about 90 microns to about 130 microns.

5. A method for rejuvenating electrostatographic carrier particles in accordance with claim 1 wherein said combustible resinous material comprises a coating on said core which modifies the triboelectric properties of said carrier particles.

6. A method for rejuvenating electrostatographic carrier particles in accordance with claim 1 wherein the maximum temperature reached by said carrier particles during said heating is from about 480° C. to about 520° C.

7. A method for rejuvenating electrostatographic carrier particles in accordance with claim 1 including continuously adding carrier particles which are to undergo heating to said carrier particles in a fluidized condition and continuously withdrawing from said fluidized carrier particles those carrier particles which have undergone sufficient heating to remove said combustible resinous material therefrom.

8. A method for rejuvenating electrostatographic carrier particles in accordance with claim 7 wherein said carrier particles which are to undergo said heating are added to said carrier particles in a fluidized condition at a rate not greater than about 1¼ Kg/sec/m$^2$ of cross-sectional area of the fluidized body of carrier particles.

9. A method for rejuvenating electrostatographic carrier particles in accordance with claim 7 wherein said carrier particles which are to undergo said heating are added to said carrier particles in a fluidized condition at a rate not greater than about 1 Kg/sec/m$^2$ of cross-sectional area of the fluidized body of carrier particles.

10. A method for rejuvenating electrostatographic carrier particles in accordance with claim 1 wherein said carrier particles are heated in said fluidized condition in a fluidized bed of said carrier particles having a depth of not more than about 5 cm.

11. A method for rejuvenating electrostatographic carrier particles in accordance with claim 10 wherein the depth of said fluidized bed is from about 3 cm to about 4 cm.

12. A method for rejuvenating electrostatographic carrier particles in accordance with claim 1 wherein the mean residence time spent by said carrier particles while heating in said fluidized condition is at least about 2 minutes.

13. A method for rejuvenating electrostatographic carrier particles in accordance with claim 1 wherein said carrier particles are heated in said fluidized condition in a single stage fluidized bed.

* * * * *